US008095995B2

(12) United States Patent
Alexander et al.

(10) Patent No.: US 8,095,995 B2
(45) **Date of Patent: *Jan. 17, 2012**

(54) ADJUSTABLE HELMET SHELL

(75) Inventors: Garnet Alexander, Beaconsfield (CA); Vittorio Bologna, Chicago, IL (US)

(73) Assignee: Sport Maska Inc., Montreal, Quebec (CA)

( * ) Notice: Subject to any disclaimer, the term of this patent is extended or adjusted under 35 U.S.C. 154(b) by 1283 days.

This patent is subject to a terminal disclaimer.

(21) Appl. No.: 11/622,875

(22) Filed: Jan. 12, 2007

(65) Prior Publication Data

US 2007/0266482 A1 Nov. 22, 2007

Related U.S. Application Data

(63) Continuation of application No. PCT/CA2005/001086, filed on Jul. 13, 2005.

(60) Provisional application No. 60/587,542, filed on Jul. 14, 2004.

(51) Int. Cl.
*A42B 1/22* (2006.01)

(52) U.S. Cl. ..... 2/417; 2/410

(58) Field of Classification Search ..... 2/410, 417, 2/418, 421

See application file for complete search history.

(56) References Cited

U.S. PATENT DOCUMENTS

| | | | | |
|---|---|---|---|---|
| 3,107,356 | A * | 10/1963 | Pestronk et al. | 2/420 |
| 3,204,251 | A | 9/1965 | Child | |
| 3,444,560 | A * | 5/1969 | Northup, Jr. | 2/8.1 |
| 3,629,864 | A | 12/1971 | Latina et al. | |
| 3,665,514 | A | 5/1972 | Durand | |
| 3,882,547 | A | 5/1975 | Morgan | |
| 4,404,690 | A | 9/1983 | Farquharson | |
| 4,477,929 | A | 10/1984 | Mattson | |
| 4,539,715 | A | 9/1985 | Clement | |
| 5,956,776 | A | 9/1999 | Chartrand | |
| 6,108,824 | A | 8/2000 | Fournier et al. | |
| 6,154,889 | A | 12/2000 | Moore, III et al. | |
| 6,159,324 | A | 12/2000 | Watters et al. | |
| 6,317,896 | B1 | 11/2001 | Timms et al. | |
| 6,324,700 | B1 | 12/2001 | McDougall | |
| 6,341,382 | B1 | 1/2002 | Ryvin et al. | |
| 6,349,416 | B1 | 2/2002 | Lampe et al. | |
| 6,385,780 | B1 | 5/2002 | Racine | |

(Continued)

FOREIGN PATENT DOCUMENTS

| | | |
|---|---|---|
| CA | 2191693 | 8/1998 |

(Continued)

*Primary Examiner* — Shaun R Hurley
*Assistant Examiner* — Andrew Sutton
(74) *Attorney, Agent, or Firm* — Norton Rose OR LLP

(57) ABSTRACT

A hockey helmet (20) comprising a front helmet portion (22) and a rear helmet portion (24) disposed to be moveable relative to each other so as to define an internal cavity of varying volume, a securing member (26) being mounted to a location on the front helmet portion (22) adjacent the temple thereof, the securing member (26) being slidable between a first or open position and a second or closed position, the rear helmet portion (24) having a restraint (28) configured and disposed to be complimentary to the securing member (26) such that when the securing member (26) cooperatively engages the restraint (28), the relative displacement of the front helmet portion (22) and the rear helmet portion (24) is inhibited. The restraint (28) comprises a number of positions in which the securing member (26) can be cooperatively engaged such that the volume of the helmet (20) may be modified.

36 Claims, 8 Drawing Sheets

U.S. PATENT DOCUMENTS

| | | | | |
|---|---|---|---|---|
| 6,418,564 | B1 | 7/2002 | Sheridan | |
| 6,425,142 | B2 | 7/2002 | Sasaki et al. | |
| 6,647,556 | B2 * | 11/2003 | Grepper et al. | 2/425 |
| 6,751,808 | B2 | 6/2004 | Puchalski | |
| 6,760,927 | B2 | 7/2004 | Guay | |
| 6,865,752 | B2 | 3/2005 | Udelhofen et al. | |
| 6,952,839 | B2 | 10/2005 | Long | |
| 6,966,075 | B2 | 11/2005 | Racine | |
| 6,968,575 | B2 | 11/2005 | Durocher | |
| 6,981,284 | B2 | 1/2006 | Durocher | |
| 6,996,856 | B2 | 2/2006 | Puchalski | |
| 7,000,262 | B2 | 2/2006 | Bielefeld | |
| 7,076,811 | B2 | 7/2006 | Puchalski | |
| 7,174,575 | B1 * | 2/2007 | Scherer | 2/418 |
| 2004/0117897 | A1 | 6/2004 | Udelhofen et al. | |
| 2004/0172739 | A1 | 9/2004 | Racine | |
| 2005/0015857 | A1 | 1/2005 | Desjardins et al. | |
| 2005/0034223 | A1 | 2/2005 | Durocher | |
| 2005/0262619 | A1 | 12/2005 | Musal et al. | |

FOREIGN PATENT DOCUMENTS

| | | |
|---|---|---|
| CA | 2273621 | 2/2000 |
| SU | 1301372 A1 | 8/1985 |

* cited by examiner

ADJUSTABLE HELMET SHELL

RELATED APPLICATION

This is a continuation of International Application No. PCT/CA2005/001086 filed Jul. 13, 2005, designating the United States, which itself claims priority on U.S. Provisional Application No. 60/587,542 which was filed Jul. 14, 2004, the specification of both of which are incorporated herein by reference.

FIELD OF THE INVENTION

The present invention relates to helmets, and is particularly concerned with adjustable helmets.

BACKGROUND OF THE INVENTION

Helmets for various activities, including sporting activities and work in dangerous environments, often require a shell or protective surface. The range of shapes and sizes of a wearer's head may require a helmet to be made larger or smaller to fit. Furthermore, adjustment may be required depending on the activity, environmental conditions, appearance, or some other factor. In particular, the wearer of a helmet may want to have a tighter or looser fit, depending on circumstances, or may alternatively want to modify the fit, for example during play, or depending on the season, etc.

Adjustable helmets typically include two sections that are moved to lengthen the helmet. For example, U.S. Pat. No. 4,477,929 to Mattsson discloses an adjustable helmet wherein adjustment typically requires the use of a screwdriver to tighten and loosen a screw. Loosening of the screw permits the helmet to be adjusted, and tightening of the screw maintains the helmet in a particular configuration. This requirement for additional tools to adjust the helmet may make it difficult to adjust the helmet when proper tools are not available. Other helmets known in the art also have limitations making them difficult or otherwise inconvenient to use.

Accordingly, there is a need for alternative helmets.

SUMMARY OF THE INVENTION

In accordance with a broad aspect of the invention there is provided a helmet comprising a first helmet portion, a second helmet portion disposed adjacent to said first helmet portion, said portions being slidably connected to one another and slidable relative to each other along a first axis so as to define an internal cavity of varying volume, a securing member mounted to a location on said first helmet portion, said securing member being slidable between an open and a closed positions, said securing member being slidable along a second axis in a plane substantially parallel to the plane of said location, said first and second axes being non-parallel, and said second helmet portion having a restraint complementary to said securing member, wherein said securing member and said restraint cooperate to inhibit movement of said first helmet portion relative to said second helmet portion when said securing member is in said closed position.

Conveniently, the present invention may further provide for a helmet wherein said restraint defines at least two recesses, said protrusion being movable to one of said recesses so as to engage said one of said recesses when said first and second helmet portions are moved closer to one another, and said protrusion being movable to another of said recesses so as to engage said another of said recesses when said first and second helmet portions are moved away from one another.

In a further embodiment of the invention, there is provided a helmet comprising a front portion and a back portion, said front and back portions defining a volume into which the head of a person will fit, said front portion comprising opposed first and second lateral portions, said back portion comprising opposed third and fourth lateral portions, said first lateral portion being configured and disposed to be adjacent said third lateral portion, said second lateral portion being configured and disposed to be adjacent said fourth lateral portion, said front portion being slidably engaged with said rear portion such that said volume is changeable, said first lateral portion comprising a depression having a bottom, said depression comprising a cavity disposed in said bottom, said cavity comprising spaced apart side edges, a securing member configured and disposed to be slidably engaged in said depression, said securing member being displaceable between an open and a closed position, said securing member comprising a base and a pedestal protruding laterally therefrom, said pedestal being sized and configured to be disposed through said cavity, said pedestal comprising opposed wings disposed to slidably engage said side edges, said pedestal comprising at least one protrusion projecting therefrom, away from said base, said third lateral portion comprising a restraint comprising an opening therethrough, said third lateral portion being sized to be larger than said cavity, said opening being disposed to cooperatively overlap said cavity, said opening comprising at least first and second spaced apart recesses on a bottom edge thereof, each of said recesses being sized to lockingly engage said protrusion, said cavity, opening, securing member and restraint being configured and disposed such that when said protrusion is lockingly engaged in said first recess, said volume is different than when said protrusion is lockingly engaged in said second recess.

In a further embodiment of the invention, there is provided an adjustment mechanism for a helmet, the helmet having a first helmet portion, a second helmet portion connected to said first helmet portion, and the portions are movable relative to each other, the adjustment mechanism comprising a securing member mounted to the first helmet portion and slidable about the first helmet portion, said securing member including at least one protrusion, and a restraint located on the second helmet portion and complementary to said securing member, wherein said securing member and said restraint cooperate to inhibit movement of said first helmet portion relative to said second helmet portion when said securing member is moved to cooperatively contact said restraint, said restraint defining a recess for engaging said protrusion when said securing member is moved to cooperatively contact said restraint.

Other and further advantages and features of the invention will be apparent to those skilled in the art from the following detailed description of embodiments thereof, taken in conjunction with the accompanying drawings.

BRIEF DESCRIPTION OF THE FIGURES

The invention will be further understood from the following detailed description of embodiments of the invention, with reference to the drawings in which.

DETAILED DESCRIPTION OF THE INVENTION

Figure 1:
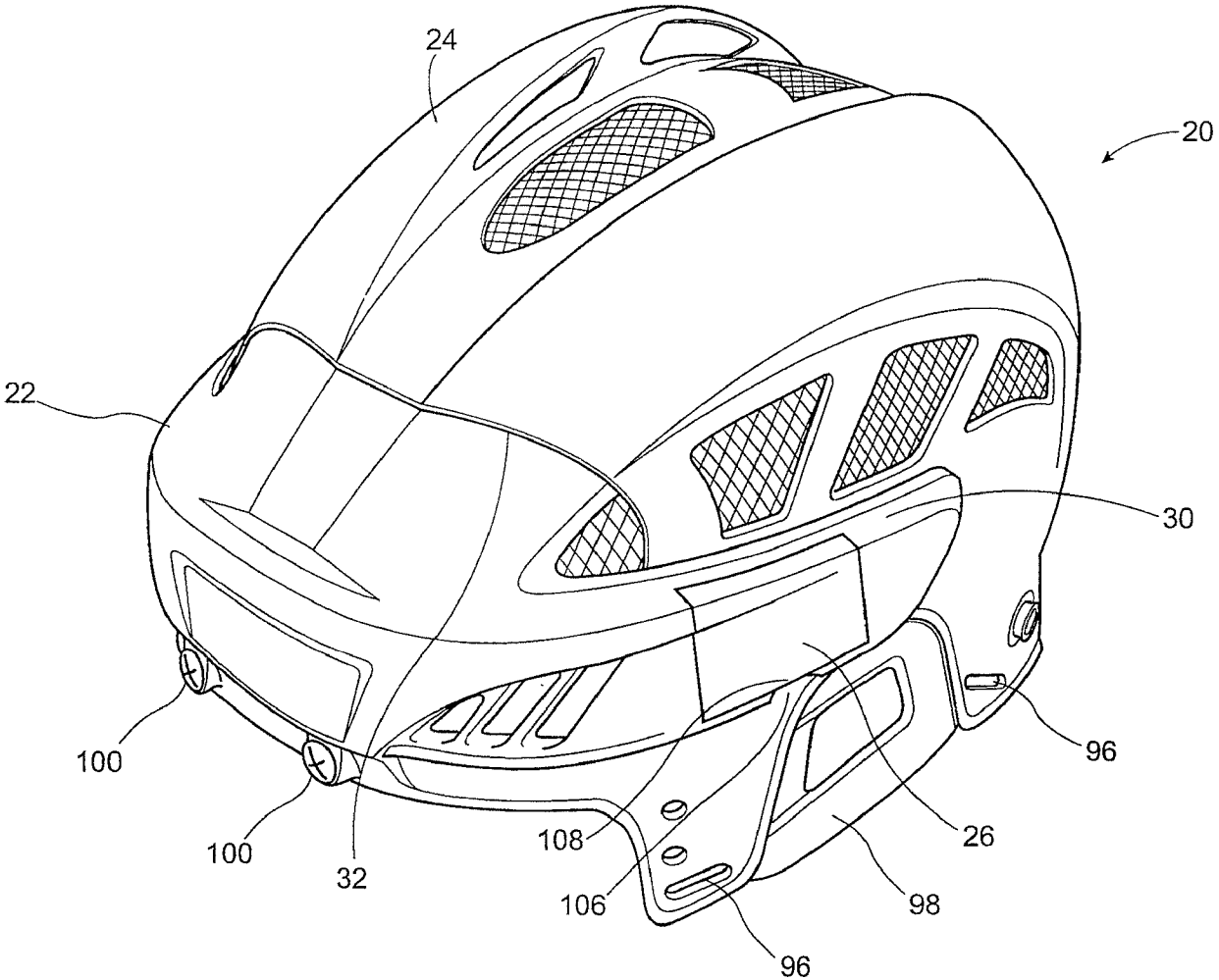
FIG. 1 illustrates in isometric view, an adjustable helmet in accordance with an embodiment of the invention.

Similar references are used in different figures to denote similar components. FIG. 1 shows an adjustable helmet in accordance with an embodiment of the invention. The adjustable helmet 20 includes helmet portions 22 and 24. Front helmet portion 22 is moveable relative to rear helmet portion 24 in a generally backward and forward direction. Front helmet portion 22 includes a securing member 26 configured and disposed to cooperates with a restraint 28 (see FIG. 3) to inhibit movement of helmet portions 22 and 24 relative to one another when securing member 26 is in a closed position. Helmet portions 22 and 24 are shown in a retracted position in FIG. 1. Although the FIGS. 1 through 12 illustrate a helmet 20 wherein rear helmet portion 24 is shown as being disposed to slide over front helmet portion 22, it is understood that the present invention may encompass the reverse.

Figure 2:
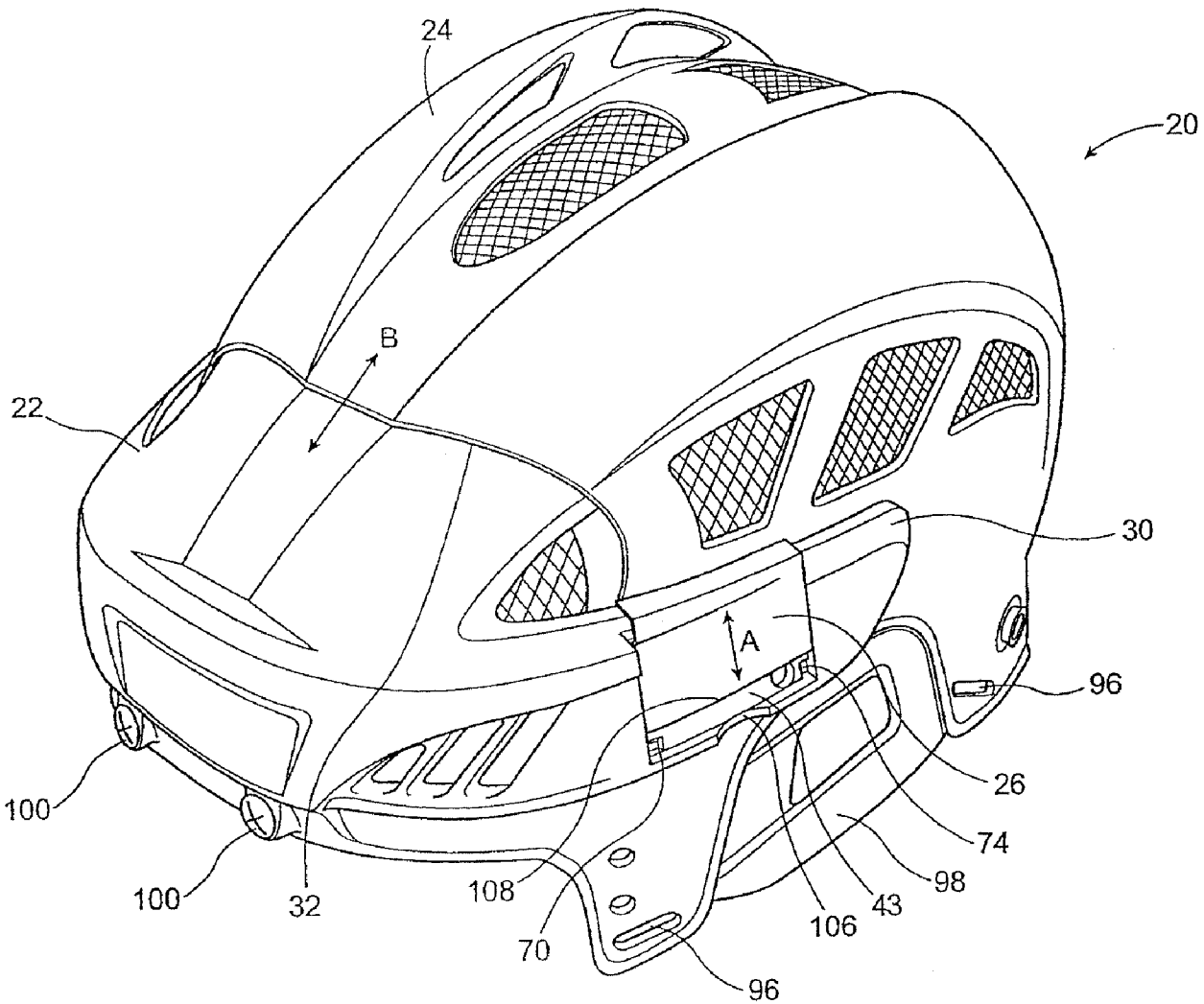
FIG. 2 is the helmet of FIG. 1 in an extended position.

In FIG. 2, securing member 26 is shown in an open position and helmet portions 22 and 24 are extended, being positioned relatively further apart than in FIG. 1, in the direction of motion arrow B. Placing securing member 26 in the open position by sliding it along the axis illustrated by motion arrow A permits helmet portions 22 and 24 to move relative to one another. This relative movement permits the helmet portions to be moved along a generally longitudinal axis of the helmet 20, as illustrated by motion arrow B. Extending helmet portions 22 and 24 away from one another serves to increase an internal volume defined by helmet 20. This increased volume may permit a wearer having a larger head to wear the helmet. Conversely, retracting helmet portions 22 and 24 towards one another serves to decrease the internal volume defined by helmet 20. This decreased volume may permit a wearer having a smaller head to wear the helmet. Such adjustment may permits a wearer to wear the helmet with greater comfort, and allow adjustment for different users. Such adjustment may also permit the same wearer to increase or reduce the volume defined by helmet 20 in order to achieve a greater or reduced tolerance between helmet 20 and the wearer's head.

In the following description of the various embodiments of the helmet, if the helmet includes more than one of a given feature, then only one such feature will generally be described. For example, helmet 20 as shown in FIG. 1 may have a securing member 26 located on either side of helmet 20. However, the description will focus on just one of the securing members. In some instances, the other like components may not be identical to those described. For example, the two securing members may be configured as mirror images of one another. Nevertheless, it will be understood that the description of one applies to the other(s) without substantial modification. Alternatively, the helmet shell of the present invention may comprise only one securing member 26, located on one or the other lateral side of the helmet.

When helmet portions 22 and 24 are moved away from (or towards) one another to a desired relative position, securing member 26 may be moved manually from the open position as illustrated in FIG. 2, to the closed position as illustrated in FIG. 1. When securing member 26 is in the closed position, it engages restraint 28 to inhibit movement of the helmet portions 22 and 24. Such inhibited movement may also make helmet 20 better able to withstand an impact by transferring the force of impact about the helmet 20. If securing member 26 is in an open position, then helmet portions 22 and 24 may be permitted to move closer to one another when one or both of portions 22 and 24 have a force applied thereto. The movement of the helmet portions towards one another may cause a clamping of the portions on a wearer's head causing discomfort and possible pain. Additionally, when securing member 26 is in an open position, portions 22 and 24 are permitted to move relative to one another. This movement may expand the volume defined by helmet 20, which may permit helmet 20 to more easily knocked or otherwise removed from a wearer's head. Such removal may be undesirable, for example, if helmet 20 is needed for protection.

In an embodiment of the invention, the securing member 26 and restraint 28 combination are paired with a second securing member and restraint (not shown). The respective securing members and restraints may be located on opposite sides of helmet 20 and may be generally laterally opposed to one another. Additional securing member/restraint combinations may be added to the helmet, as needed (not shown).

Figure 3:
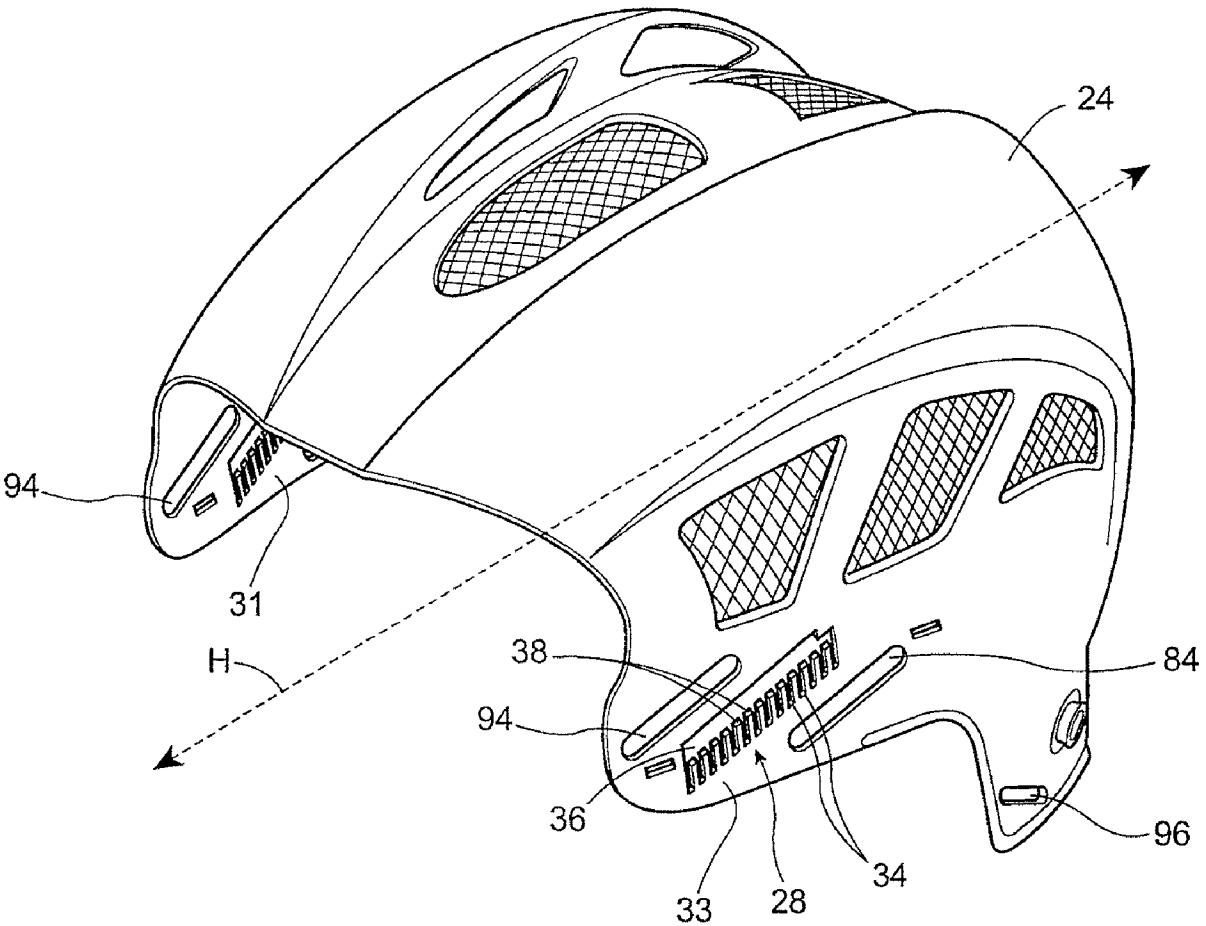
FIG. 3 is an isolated isometric view of a rear helmet portion of the helmet of FIG. 1.
Figure 10:
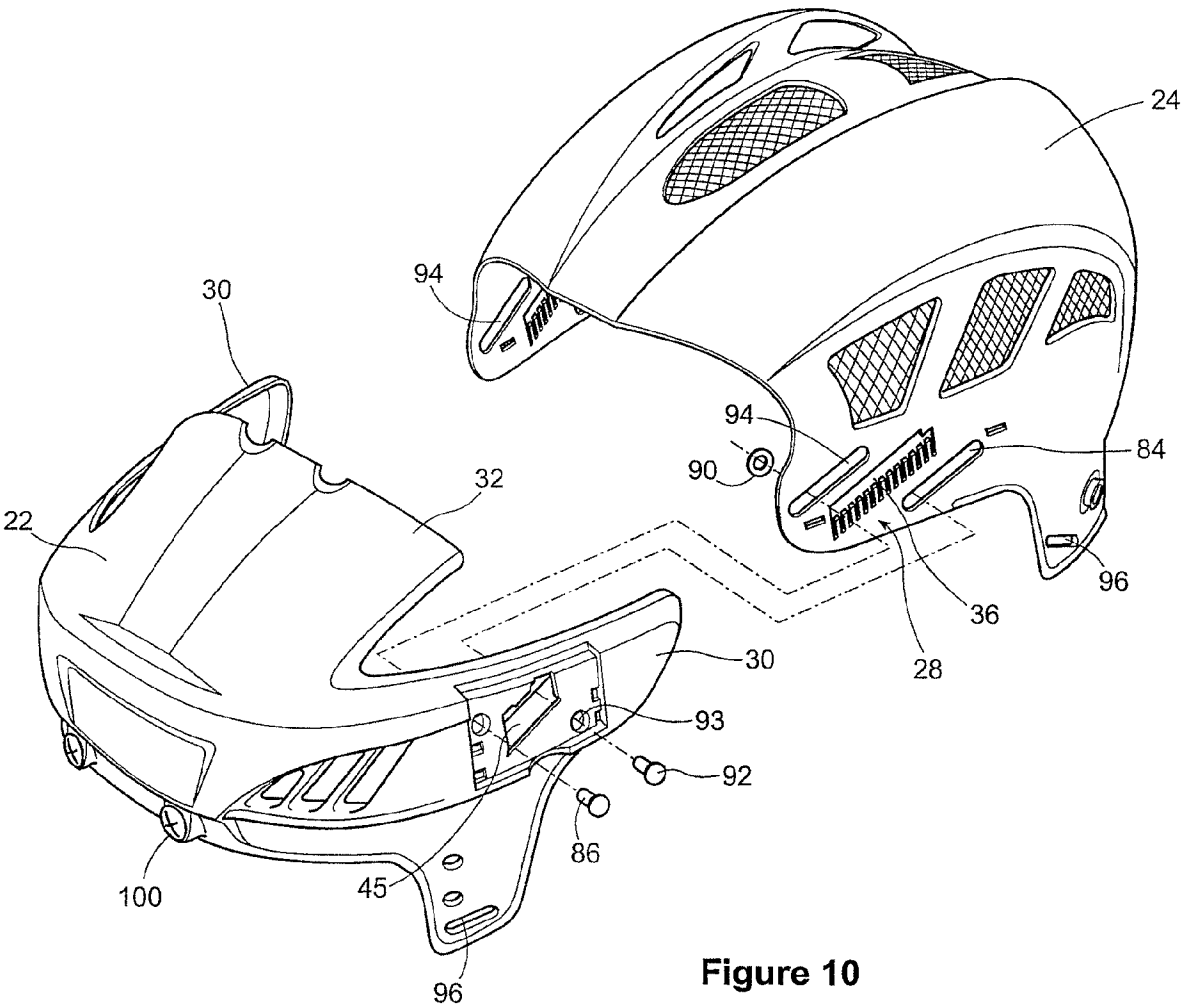
FIG. 10 illustrates an exploded view of the front and rear helmet portions of the helmet of FIG. 1.

Front helmet portion 22 includes at least one, and preferably two, overlapping portions 30 (i.e. first lateral portion and second lateral portion, shown in FIG. 10), and at least one underlapping portion 32. Helmet 20 may be initially assembled by positioning underlap portion 32 (which in an embodiment is between overlapping portions 30) within concave rear portion 24. At the same time, overlapping portions 30 may be aligned along a convex side of rear helmet 24. This arrangement may permit front and rear portions 22 and 24 to move relative to one another. The portions 22 and 24 are preferably configured to slideably engage one another, though other configurations, for example, without slideable engagement of underlapping portion 32 are possible. Rear helmet portion 24 comprises third and fourth lateral portions 31 and 33, as best illustrated in FIG. 3.

As shown in FIGS. 1 and 2, rear helmet portion 24 is configured to be larger than front helmet portion 22. Alternatively, the relative sizes of portions 22 and 24 may be modified, including having front portion 22 being larger than rear helmet portion 24.

Helmet portions 22 and 24 are shown in a front-rear configuration. Alternatively, helmet portions may be configured in some other configuration, including non-symmetrical configurations. For example, helmet portions could be configured to interface along a longitudinal axis of helmet 20. Such arrangement may permit widthwise adjustment of the volume defined by helmet 20 along a general lateral axis (not shown).

Securing member 26 may be located on overlap portion 30, and restraint 28 may be located on rear helmet portion 24 adjacent to overlapping portion 30, i.e. or on third lateral portion 31 and on fourth lateral portion 33. As illustrated, securing member 26 may be disposed to fit into, or substantially fit into a depression 43 disposed or located on overlap portion 30. Alternatively, securing member 26 may be located on the inside of rear helmet portion 24, with securing member 26 located on overlapping portion 30. In i further alternative, securing member 26 and restraint 28 may be respectively located on one of underlapping I portion 32 and a corresponding area of rear helmet portion 24.

It is also possible to configure helmet 20 so that front helmet portion 22 entirely overlaps rear helmet portion 24. Alternatively, front helmet portion 22 may be configured to entirely underlap rear helmet portion 24. Some combination of the foregoing may also be possible with appropriate modifications made to the securing member 26 and restraint 28.

In FIG. 3, restraint 28 is shown in isolation. Restraint 28 may be integral with helmet t portion 24 and may define at least one recess 34. Recess 34 may receive a complementary portion (discussed in detail below) of securing member 26 to inhibit relative movement of helmet portions 22 and 24. Restraint 28 also defines a passage 36 to permit movement of the complementary portion of securing member 26 to clear recess 34 and to permit helmet portions 22 and 24 to move relative to one another. In the present embodiment, recess 34 and passage or opening 36 are shown as an opening in helmet portion 24.

However, they need only be defined as indents or rebates sufficient to permit engagement and movement of securing member 26. As illustrated, recess 34 is disposed below passage 36, although the reverse may be possible, as is other relative configurations thereof.

FIG. 3 also illustrates a plurality of recesses 34 defined by generally parallel fingers 38. Recesses 34 provide a receptacle for engaging securing member 26. When securing member 26 is in an open position, it is moveable along passage 36 as helmet portions 22 and 24 are moved relative to one another. When a desired relative displacement of helmet portions 22 and 24 is achieved, securing member 26 may be moved to a closed position to engage adjacent fingers 38 of a passage 36. When securing member 26 is engaged in this manner, movement of helmet portion 22, which is connected to securing member 26, may be inhibited.

The relative size and positioning of fingers 38 may be used to vary the degree of relative displacement of helmet portions 22 and 24. For example, narrower fingers 38 and/or recesses 34 may permit finer adjustment of the volume of helmet 20. If fingers 38 are configured as shown in the figures, a sufficient amount of material should be used to inhibit undesirable bending, deformation or breakage of the finger 38 when a force is applied to one or both of helmet portions 22 and 24 when securing member 26 is closed. The plastic which may be used for the present invention is conventional plastic commonly used for helmet manufacturing and sports equipment manufacturing. It is however understood that other types of materials and plastics may be used in stead of or in addition or in combination with presently used plastics. While a plastic or polymer may be used to construct securing member 26 and restraint 28, stronger materials, such as a metal may be used to permit fingers 38 to define more closely spaced recesses 34 to permit finer degrees of adjustability. Such alternative materials may optionally be installed as an insert to helmet portion 24 so that other components of helmet 20 need not be made of the same material. In an embodiment of the invention, dimensions of fingers 38 are in the range of approximately 0.5 mm wide to approximately 5.0 mm wide, and from approximately 0.5 mm high to approximately 10 mm high. Also, recesses 34 are in the range of approximately 0.5 mm wide to approximately 5.0 mm wide, and from approximately 0.5 mm high to approximately 10 mm high. It is understood that these dimensions may be greater or smaller. The dimensions of each recess 34 and/or finger 38 need not be uniform. Different spacings, heights and dimensions may provide varying degrees of adjustability than the illustrated embodiments of restraint 28.

In an embodiment, thirteen fingers are provided. Fingers 38 may be spaced to permit a maximum relative displacement of helmet portions 22 and 24 of about 10 to 15 millimeters. Lengthening of restraint 28 may permit increased displacement of helmet portions 22 and 24. Conversely, a reduction in restraint 28 may constrict the extent to which helmet portions 22 and 24 may be displaced from one another.

As illustrated in FIG. 3, restraint 28 is inclined at approximately 20 to 40 degrees from horizontal H (horizontal is defined by the orientation of helmet 20 when it is worn). Restraint 28 may alternatively have a different orientation either on a greater or lesser incline. For example, restraint 28 may be positioned horizontally. In a particular embodiment, the angle of inclination of restraint 28 may be so as to facilitate as much as possible the relative displacement of helmet portions 22 and 24. Whatever the orientation of restraint 28, recesses 34 are configured to permit engagement of securing member 26 as it is moved between open and closed positions so that movement of helmet portions 22 and 24 may be inhibited.

In the illustrated embodiment, fingers 38 engage securing member 26. Because securing member 26 is mounted to front helmet portion 22, relative movement of front helmet portion 22 is also inhibited. To achieve this, movement of securing member 26, for example in the general direction of axis A (see FIG. 2), may not be parallel to movement of front helmet portion 22, for example in the general direction of axis B. Securing member 26 is movable about a surface of helmet 20 generally along axis A. This movement need not be perfectly linear and may follow a curve such as a curve generally congruent the curvature of helmet 20 adjacent securing member 26. This arrangement permits a force applied to one helmet portion to be transferred to the other helmet portion by securing member 26 when securing member 26 is in a closed position. This arrangement may provide additional protection to a wearer of helmet 20.

In the illustrated embodiment, restraint 28 includes fingers 38 for engaging securing member 26. The particular configuration of fingers 38 may be modified so long as they engage a corresponding feature of securing member 26 to inhibit relative movement of helmet portions 22 and 24. For example, fingers 38 may be formed as generally triangular teeth (not shown) to receive a complementary feature of securing member 26. In a further alternative embodiment, restraint 28 may include a surface or substance for frictionally engaging securing member 26. For example, a deformable foam rubber (not shown) of restraint 28 may be configured to engage a corresponding rubber surface of securing member 26 so that when securing member 26 is in a closed position, the complementary pieces of foam rubber compress and frictionally engage to inhibit relative movement of helmet portions 22 and 24. Alternatively, securing member 26 may have prongs or some other feature for engaging a non-similar feature of restraint 28, such as foam rubber. In a further alternative embodiment, restraint 28 may have one-half of a Velcro® type hook and loop fastener, and securing member 26 may have the other half of such fastener for releasable engagement with restraint 28.

Figure 5:
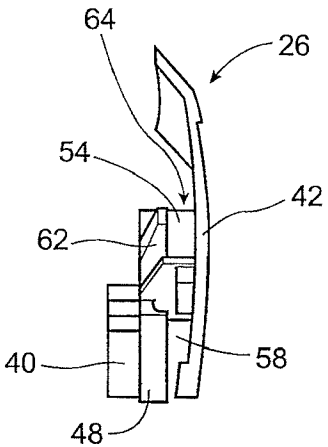
FIG. 5 is an end view of the securing member of FIG. 4.
Figure 4:
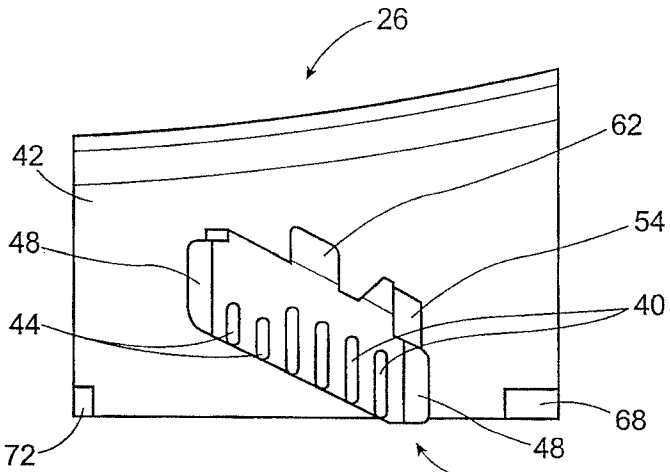
FIG. 4 is an isolated side view of a securing member of the helmet of FIG. 1.
Figure 6:
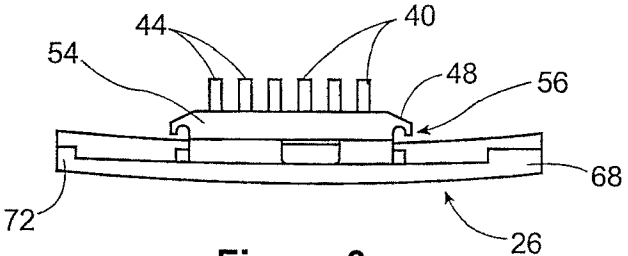
FIG. 6 is an isolated bottom view of the securing member of FIG. 4.

As shown in FIGS. 4, 5 and 6, securing member 26 includes at least one, and preferably more than one, protrusion 40. Protrusions 40 may extend from securing member 26, in a non-parallel direction relative to the direction that fingers 38 extend. At least one protrusion 40 is at least partially locatable within a restraint recess 34 when securing member 26 is moved to a closed position because at least a portion of each protrusion 40 is configured to be engagable between fingers 38 of restraint 28. Protrusions 40 may be elongate and may extend from a body 42 of securing member 26. Alternatively, securing member 26 may instead include a feature similar to the fingers of restraint 28 in which the protrusions of securing member 26 extend finger-like in a generally parallel direction relative to the direction that fingers 38 extend, to intermesh with fingers 38 (not shown). In a further alternative, securing member 26 may include some other feature such as pointed teeth (not shown) for engaging a corresponding feature of restraint 28 when securing member 26 is in the closed position.

In an embodiment, securing member 26 includes six protrusions of which two protrusions 44 are shortened. Shortened protrusions 44 may serve to permit freer movement of securing member 26 between open and closed positions. Shortened protrusions 44 permit securing member 26 to clear edges of passage 36 (see FIG. 8, for example). Helmet 20 may be configured to permit protrusions all having a similar length, or having varying lengths. Further, an embodiment may provide for more or less protrusions than six.

Protrusions 40 are made of sufficient material to resist deformation when engaged with restraint 28 and a force is applied to helmet 20, for example, during game play. Securing member 26 may be made of the same or a similar material as restraint 28, or the remainder of helmet 20. Alternatively, a different material may be used, such as a different plastic, polymer, or other material including an alloy or metal such as aluminum or any combination thereof.

Increased resistance to deformation may be achieved by configuring securing member 26 and restraint 28 so that more than one protrusion 40 may engages more than one finger 38 of restraint 28. In the illustrated embodiment all six protrusions 40 may engage corresponding fingers 38 in each of the possible adjusted positions of helmet portions 22 and 24 where securing member 26 is in a closed position. Accordingly, helmet 20 may be adjusted to nine different relative positions of front and rear helmet portions 22 and 24. As noted, increasing the number of recesses 34, and/or reducing the number of protrusions 44 may be used to vary the adjustability of helmet 20.

Figure 7:
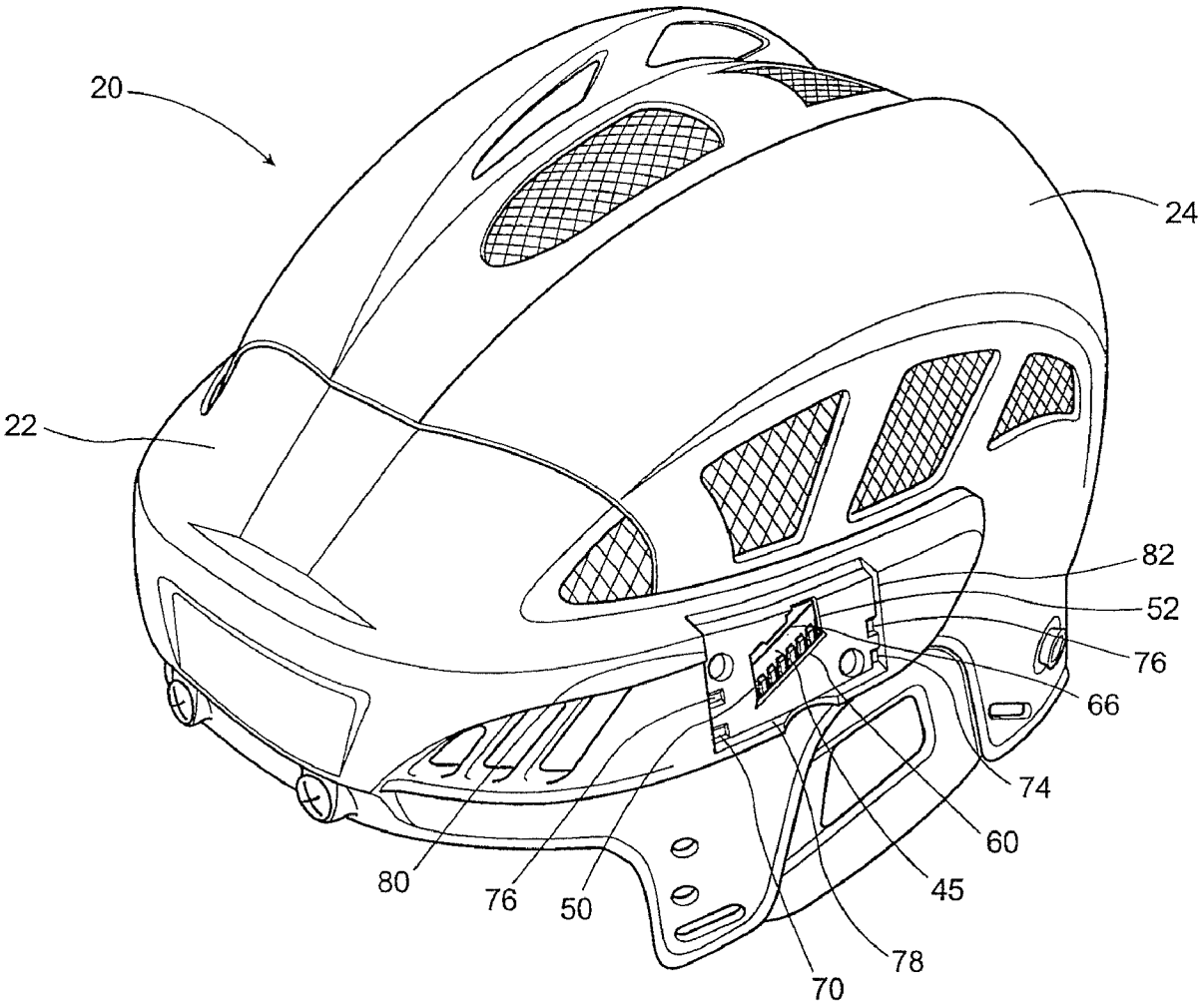
FIG. 7 is an isometric view of the helmet of FIG. 1 wherein the securing member has been removed.

Referring additionally to FIG. 7, front helmet portion 22 may include an opening or cavity 45 for mounting securing member 26. Securing member 26 may include a retainer 46 for connecting securing member 26 to front helmet portion 22. Retainer 46 may include at least one wing 48 for engaging an edge of opening 45. In an embodiment, two deformable wings are integrally formed in a single piece securing member 26. This may be done, for example, by injection moulding. Wings 48 are spaced a marginally greater distance from one another than a width of opening 45. Deformable marginally wider wings 48 may be forced through opening 45 causing wings 48 to temporarily deform. Once wings 48 clear opening 45 they resiliently return substantially to their initial form to co-operate with body 42 to engage an edge of opening 45 to inhibit their removal from opening 45. This deformation may be made sufficient to permit removal and replacement of securing member 26 in order to clean, repair or replace components of helmet 20.

Opening 45 may have aligned edges 50 and 52 which are received by retainer 46. The orientation of edges 50 and 52 permits slideable movement of securing member 26 along an axis A between the open and closed positions. Alternatively, edges 50 and 52 may be notched or stepped permitting the removal and replacement of securing member 26 in one or more positions so that protrusions 40 may be engaged or disengaged with restraint 28, as desired. In a further alternative embodiment, opening 45 may be configured to inhibit sliding movement of securing member 26. In this configuration, securing member 26 may be removed, then helmet 20 may be adjusted, and securing member 26 may then be replaced to maintain the adjusted position of helmet portions 22 and 24.

Securing member 26 may alternatively be made in two or more pieces and may be installed by placing structure including protrusions 40 on one side of helmet opening 45, and placing body 42 of the securing member on the other side, and gluing, screwing or otherwise fastening the two parts to one another to engage at least an edge of opening 45.

As described above, restraint 28 may be angled relative to horizontal H. Similarly, securing member 26 may likewise be angled so that protrusions 40 align with and engage securing member 26.

In an embodiment, protrusions 40 (or other suitable engagement member) may be mounted to a support 54 of securing member body 42. Wings 48 may extend, for example laterally, from support 54. Support 54 may be configured to have a retaining feature 56 defining a groove 58. Groove 58 may receive another edge 60 of opening 45. Groove 58 preferably corresponds to a thickness of edge 60 so that edge 60 may be received therein. Thus, as may be understood, retaining feature 56 may, when in use, slidably engage edge 60 such that such engagement allows the guiding of securing member 26 up and down. In operation, edge 60 may enter groove 58 when securing member 26 is moved to a closed position. This feature may further retain securing member 26 within opening 45. Support 54 may additionally include a retaining feature in the nature of a tab 62. Tab 62 together with body 42 defines a rebate 64 for receiving an edge such as edge 66 of opening 45. Tab 62 may inhibit removal of securing member 26 from opening 45 when securing member 26 is in an open position and tab 62 engages opening edge 66.

Wings 48, together with retaining features 56 and 64 permit slideable movement of securing member 26 while retaining securing member 26 within opening 45. Thus, as may be understood, securing member 26 is retained in slidable engagement with helmet portion 22.

Securing member 26 may have one or more of wing 48, retaining feature 56 and retaining feature 62. These features need not be arranged precisely as disclosed herein. Alternative embodiments may employ, for example, wings in place of tab 62 and retaining feature 56. Furthermore, multiple tabs 62, or other such features, may engage a given edge of opening 45, such as edge 66.

As illustrated in FIG. 6, each wing 48 may be angled from support 54 towards body 42. This may serve to provide a certain amount of resilience in wings 48 for retaining an edge of opening 45. This may also allow for manufacturing tolerances.

As illustrated in FIG. 7, opening 45 is shown as having a somewhat parallelogram shape. It may alternatively be configured in some other shape, such as a rectangle, or curved, which still permits engagement of securing member 26 and restraint 28. Opening 45 is also preferably large enough to permit movement of protrusions 40 away from restraint fingers 38 to permit adjustment of helmet portions 22 and 24 (see FIG. 8 where protrusions 40 are permitted to clear fingers 38).

Referring to FIGS. 2, 4 and 7, securing member 26 may be additionally provided with a feature for discouraging movement of securing member 26 when it is engaged with restraint 28. For example, a protuberance 68 may be mounted to or integrally formed in securing member 26. Protuberance 68 may be mounted to body 42 and may extend towards front helmet portion 22 when securing member 26 is mounted thereto. Front helmet portion 22 may define a corresponding indent 70 for receiving protuberance 68 when securing member 26 is in a closed position. In operation, protuberance 68 may be permitted to slide along, or adjacent to, a surface of front helmet portion 22 as securing member 26 moves from the open position to the closed position. Once in the closed position, protuberance 68 is permitted to rest within indent 70. Multiple such protuberances and corresponding indents maybe employed (the indent and protuberances may also be reversed or varied, with one or more protuberances being located on helmet 20 and corresponding indents being located on securing member 26). In an embodiment, a second protuberance 72 may cooperate with a second indent 74 of front helmet portion 22 to further inhibit movement of securing member 26 when it is in the closed position. Protuberance 68 may be larger (or smaller than) second protuberance 72. A larger protuberance (and corresponding indent) may serve to provide greater resistance to movement of securing member 26 from the closed position.

One or more additional indents 76 may optionally be added to front helmet portion 22 to receive a protuberance such as protuberance 68, when securing member 26 is in the open position. This encourages securing member 26 to clear restraint 28 when helmet portions 22 and 24 are adjusted, without the need to manually maintain securing member 26 in the open position.

As shown in FIG. 7, front helmet portion 22 may be provided with a rebate 78 for receiving at least a portion of securing member body 42. Body 42 may be made to conform to edges 80 and 82 of rebate 78. Edges 80 and 82 are preferably aligned with an axis of movement of securing member 26 between open and closed positions, such as axis A. In such configuration, edges 80 and 82 may encourage movement of securing member 26 so that it clears restraint 28 in the open position and engages restraint 28 in the closed position.

Depending on the closeness of the fit between restraint 28, securing member 26 and rebate edges 80 and 82, it may be possible for securing member 26 to further resist movement of helmet portions 22 and 24 at the interface where it meets edges 80 and 82 when securing member 26 is in the closed position. In an embodiment, when securing member 26 is in the closed position and helmet 20 experiences a force applied thereto, such force is transferred between helmet portions 22 and 24 via securing member support 54, protrusions 40 and fingers 38. A force may also be transferred between one or both of rebate edges 80 and 82 and securing member body 42.

In an alternative embodiment, a securing member may be mounted to rear helmet portion 24 for engagement with a corresponding restraint located on underlapping portion 32.

In a further alternative embodiment, securing member 26 may be slideably mounted to helmet portion 22 with a portion of securing member 26 extending beyond helmet portion 22 to engage a restraint located in a non-overlapping portion of rear helmet 24. For example, the securing member could be slideably mounted along its edge to extend from helmet overlapping portion 30 to engage a restraint located on rear helmet 24. This embodiment may operate in a substantially similar manner to that of the embodiments shown in the figures. Securing member 26 may also be mounted to the inside of helmet 20 on rear helmet portion 24, with restraint 28 being located on front helmet portion 22.

Referring again to FIG. 3 and to FIG. 10, helmet portions 22 and 24 may be slideably mounted to one another. At least one slot 84 may be defined in rear helmet portion 24. In an embodiment of the invention, slot 84 passes through helmet portion 24. However, slot 84 may also be configured as an added or integrally formed aperture extending from helmet portion 24. A guide in the nature of a post 86 may be disposed, for example, through front helmet portion 22 extending into slot 84. Post 86 may be retained within slot 84 by deforming end 88 of post 86 (see FIGS. 8 and 9). Post 86 may alternatively or additionally include a retention feature to inhibit removal of post 86 from slot 84. For example, a washer 90 may be assembled to post 86 and secured thereto, for example, by deforming an end of post 86. In an embodiment, post 86 may be made of a metal, such as a deformable non-corrosive metal, and may be generally in the form of a rivet-like structure.

Post 86 may be fixed permanently to front helmet portion 22 or may be separate therefrom. In an embodiment, post 86 includes a head 92. Post 86 is mounted by inserting it through an opening 93 in front helmet portion 22 that permits passage of post 86 but inhibits further insertion of post head 92, as shown in FIG. 10. In a further embodiment, post 86 may be integrally moulded with front helmet portion 22.

Slot 84 is configured to permit sliding movement of front and rear helmet portions 22 and 24 relative to one another to permit securing member 26 to engage restraint 28 in at least one, and preferably more than one, position. For example, slot 84 may be disposed and configured so as to be aligned with passage 36, such that securing member 26 is encouraged or urged to move without obstruction along passage 36 in the open position when front helmet portion 22 is moved relative to rear helmet portion 24. Securing member 26 may then be selectively moved to the closed position to engage restraint 28 to retain front and rear helmet portions in a preferred relative orientation. Slot 84 has a generally longitudinal axis which is oriented to encourage movement of helmet portion 22 along an axis corresponding to axis B. Preferably, slot 84 measures from 3 to 30 millimeters long to permit relative movement of the helmet portions relative to each other of similar magnitude.

Slot 84 is shown in FIG. 3 as running generally alongside restraint 28. Alternatively, it may be located in a position not alongside restraint 28 but oriented parallel to a similar axis to encourage or facilitate the relative movement of the helmet portions described above.

An additional slot 94 may be similarly configured adjacent restraint 28. Slot 94 further serves to encourage movement of helmet portions 22 and 24 to vary the volume defined by helmet 20 to accommodate different sized heads or other user preferences. Slot 94 may alternatively be located alongside slot 84 or in some other position on rear helmet portion 24 to encourage the desired relative movement of helmet portions 22 and 24.

Alternatively, slot 84 (and/or slot 94) may be located on front helmet portion 22, with a corresponding post, such as post 86, located on rear helmet portion 24. Other arrangements, such as an integrally formed protrusion extending from front helmet portion 22 that slideably engages slot 84 in a snap fit may be employed to mount front helmet portion 22 to rear helmet portion 24.

Slots, for example slot 84, may additionally include a bump or other feature along a longitudinal edge thereof (not shown). The areas between such bumps may be located to correspond with restraint recesses 34. This arrangement may permit a more convenient locating of securing member protrusions 40 within recesses 34 because post 86 will be encouraged to rest between such bumps.

In alternative embodiments, helmet portions 22 and 24 may be mounted in some other manner, for example, by a hinge, or pivot points. Such arrangement may require that the features of restraint 28 and securing member 26 be curved or arched so that they may follow a line of travel of front helmet portion 22 motion relative to rear helmet portion 24.

Helmet portions 22 and 24 may alternatively be formed as a single piece with a deformable area therebetween, permitting relative movement of the two portions. The features of the helmet may be as described above with some modification.

Helmet 20, depending on the purpose for which it is intended, may have additional features such as chin strap mounts 96, ear guard 98 and features, such as screws 100, for mounting a face guard.

Figure 8:
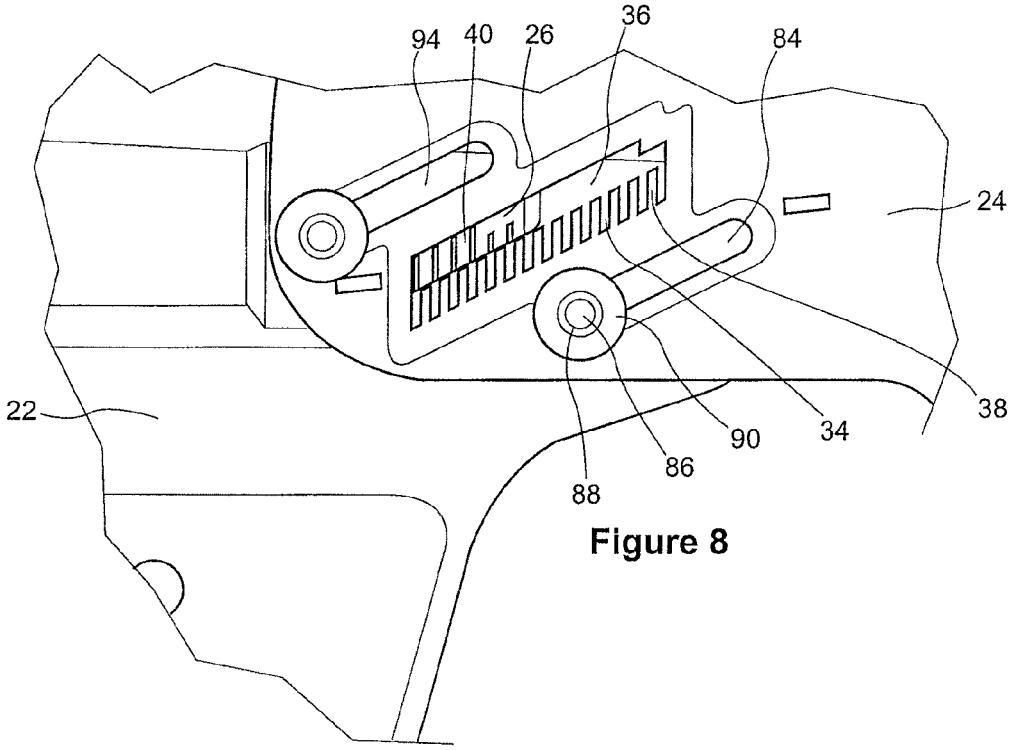
FIG. 8 illustrates a portion of the helmet of FIG. 1 showing the securing member in an open position.

As shown in FIG. 8, securing member 26 is permitted to move freely within passage 36 when in the open position. Protrusions 40 may be permitted to span passage 36 to further guide movement of helmet portions 22 and 24 relative to one another when securing member 26 in the open position. Alternatively, protrusions 40 are not configured to span passage 36.

Figure 9:
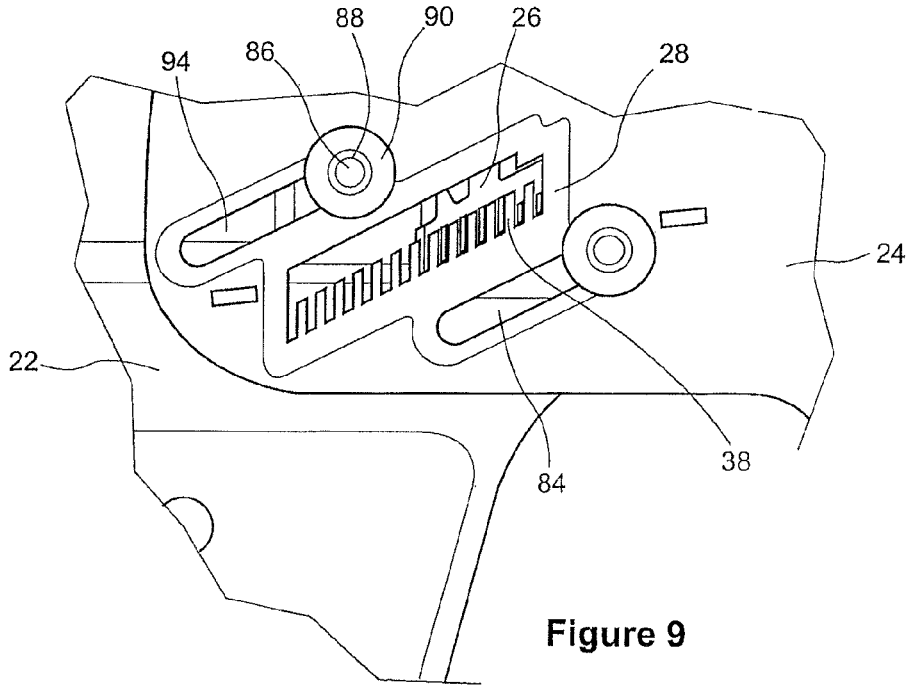
FIG. 9 illustrates the portion of FIG. 8 with the securing member in a closed position.

FIG. 9 shows securing member 26 engaging restraint 28 to inhibit movement of helmet portions 22 and 24 relative to one another. Partial engagement of securing member 26 and restraint 28 may also serve to sufficiently inhibit movement of helmet portions 22 and 24 to remain in their relative positions.

Figure 11:
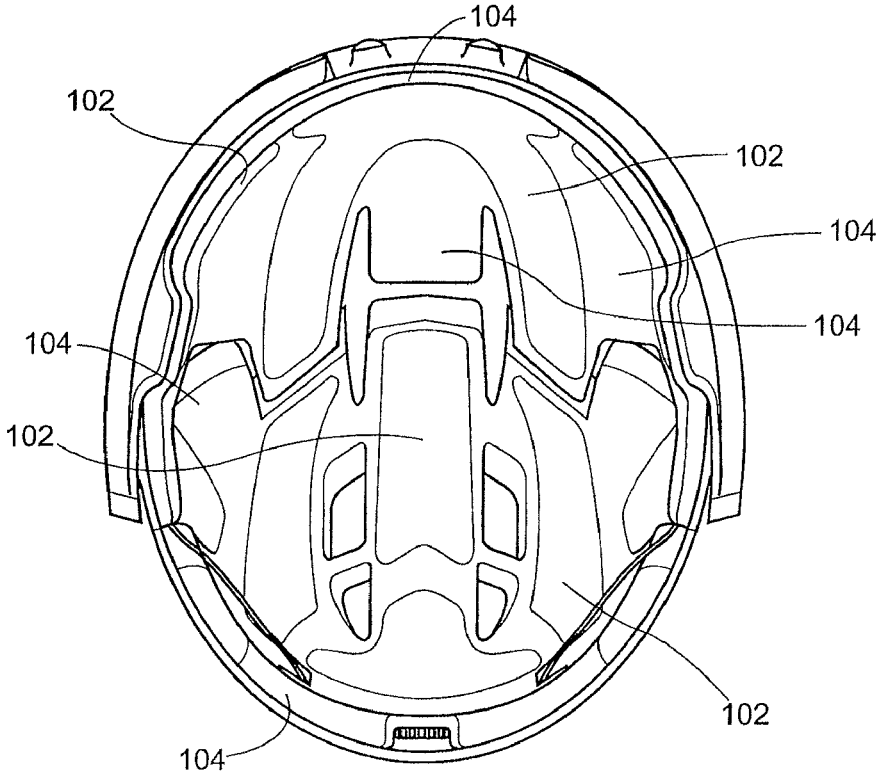
FIG. 11 illustrates a bottom view of the helmet of FIG. 1 in a retracted position.
Figure 12:
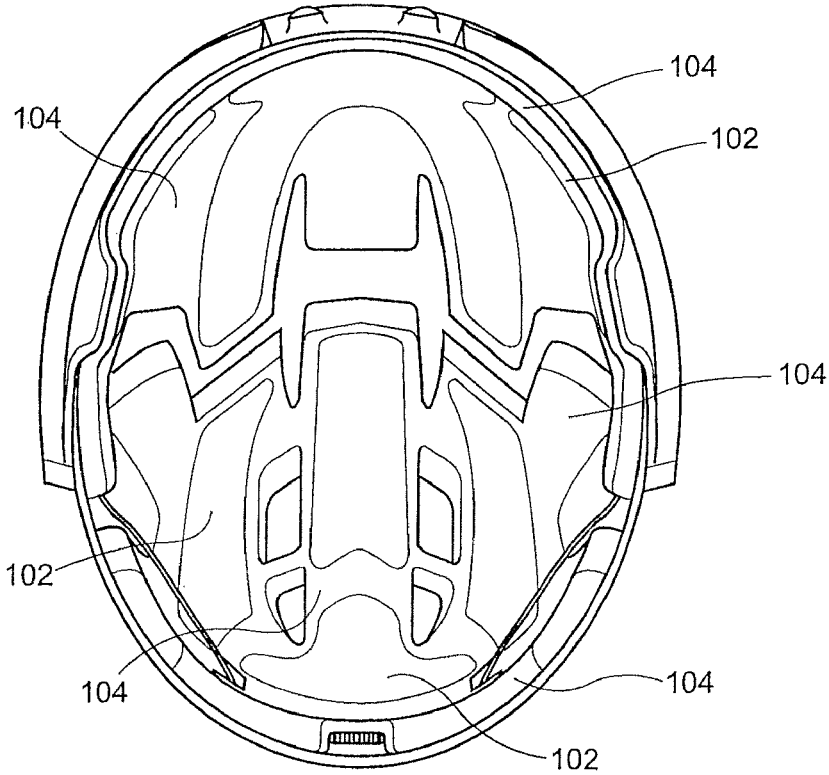
FIG. 12 illustrates a bottom view of the helmet of FIG. 1 in an extended position.

FIGS. 11 and 12 illustrate the relative positioning of front and rear helmet portions 22 and 24 in respective retracted and extended positions. Comfort padding 102 and/or protective padding 104 may be added to helmet 20. As shown in the figures, separate padding may be added to each portion 22 and 24 so that the padding moves with its attached helmet portion 22 or 24, as the case may be.

Helmet 20 may be adjusted by a wearer while worn or when removed. It may be adjusted manually, without the use of tools, for example, when it is held. Of course, a third party may also adjust the helmet while it is on a wearer. Securing members 26 are moved to the open position (in the present example helmet 20 has two securing members 26 and corresponding restraints 28 located laterally on either side of helmet 20). Helmet portions 22 and 24 may then be moved relative to one another to increase or decrease the volume defined by helmet 20. Once a desired relative positioning of front and rear helmet portions 22 and 24 is achieved, securing member 26 may then be moved to the closed position. This is done for each securing member/restraint combination.

Alternatively, helmet portions 22 and 24 may be extended, including fully extended, prior to placement on a wearer's head. This may provide greater clearance for location on the head. Once placed on the head, helmet portions 22 and 24 may be adjusted as described herein to better fit the wearer.

If helmet 20 is adjusted while worn, adjustment of helmet 20 may be carried out in a similar manner. Securing members 26 are moved to the open position, preferably at about the same time. Following this, front and rear helmet portions 22 and 24 are moved relative to one another until a desirable or comfortable fit is achieved. Securing members 26 are then moved to the closed position. This procedure may be carried out by using the thumbs of each hand to move a respective securing member 26 to the open position. Helmet portions 22 and 24 may then be relatively quickly adjusted, and the securing members 26 may then be returned to the closed position using each hand to close the securing member 26 at approximately the same time (or the same hand may be used to open and close securing member 26 and to adjust helmet 20). This process may take a matter of seconds, and may even be carried out, for example, during game play, as needed. Helmet 20 may also be adjusted while wearing gloves, depending to some extent on the bulk and flexibility of the gloves used. A notch 106 may be formed in front helmet portion 22 to provide access to an edge 108 of securing member 26 (see FIGS. 1 and 2). A force may then be applied to edge 108 to encourage movement of securing member 26 to the open position.

As illustrated in FIG. 10, helmet 20 may be assembled by first mounting guides 86 into front helmet portion 22. The front and rear helmet portions 22 and 24 may then be assembled by inserting guides 86 into slots 84. Following this, washers 90 may be mounted to respective posts 86 and post ends 88 may then be formed to retain washer 90. Securing members 26 are then mounted, for example, by a snap fit, into openings 45.

Helmet portions 22 and 24 and securing member 26 are preferably made of a resilient deformable plastic such as thermaformable plastic, or any other plastic which may normally be used for sport equipment, such as football helmets, football shoulder pads, hockey shoulder pads, etc. . . . .

The foregoing description of various embodiments of the invention is made in the context of a hockey helmet. Nevertheless, the various embodiments may be applied to other types of helmets, as appropriate, including helmets used in other sports (e.g., football, lacrosse, skiing, skateboarding, rollerblading), for hazardous work environments or, perhaps less commonly, for fashion.

While the foregoing embodiments of the invention have been described in some detail for purposes of clarity and understanding, it will be appreciated by one skilled in the art, that numerous modifications, variations, and adaptations may be made to the particular embodiments of the invention described above without departing from the scope of the invention, which is defined in the following claims.

What is claimed is:

1. A helmet comprising:

a first helmet portion;

a second helmet portion disposed adjacent to said first helmet portion, said portions being slidably connected to one another and slidable relative to each other along a first axis so as to define an internal cavity of varying volume;

a securing member mounted to a location on said first helmet portion, said securing member being slidable between an open and a closed position, said securing member being slidable along a second axis in a plane substantially parallel to the plane of said location, said first and second axes being non-parallel; and said second helmet portion having a restraint complementary to said securing member, wherein said securing member and said restraint cooperate to inhibit movement of said first helmet portion relative to said second helmet portion when said securing member is in said closed position.

2. The helmet of claim 1, wherein said securing member includes at least one protrusion, and said restraint defines a recess for engaging said protrusion when said securing member is moved to the closed position.

3. The helmet of claim 1, wherein said securing member is slidable in the plane of said location.

4. The helmet of claim 2 wherein said restraint defines at least two recesses, said protrusion being movable to one of said recesses so as to engage said one of said recesses when said first and second helmet portions are moved closer to one another, and said protrusion being movable to another of said recesses so as to engage said another of said recesses when said first and second helmet portions are moved away from one another.

5. The helmet of claim 1 wherein said helmet portions overlap one another, said securing member and said restraint being located on corresponding overlapping areas of said helmet portions.

6. The helmet of claim 2 wherein said recess is defined within the plane of said location.

7. The helmet of claim 1 wherein said second axis is generally vertical when said helmet is worn.

8. The helmet of claim 4 wherein a longitudinal axis of said recesses is oriented generally parallel to said second axis; and a longitudinal axis of said protrusions is oriented generally parallel to said second axis.

9. The helmet of claim 8 wherein said recesses are defined by pointed teeth of said restraint, and said protrusions intermesh with said teeth when said securing member is in said closed position, and said protrusions clear said teeth when said securing member is in said open position, permitting said helmet portions to move relative to one another.

10. The helmet of claim 8 wherein said recesses are defined by generally parallel fingers of said restraint, and said protrusions intermesh with said fingers when said securing member is in said closed position, and said protrusions clear said fingers when said securing member is in said open position, permitting said helmet portions to move relative to one another.

11. The helmet of claim 10 wherein said generally parallel fingers terminate along an axis generally parallel to said first axis, and said protrusions are aligned along an axis generally parallel to said first axis permitting said fingers and said protrusions to clear each other when said securing member is moved to said open position.

12. The helmet of claim 1 wherein said slidable connection includes:

a first slot defined by at least one of said first and second helmet portions; and a guide located on the other of said helmet portions and being slidably retained within said slot.

13. The helmet of claim 12 wherein said slidable connection further comprises a second slot oriented generally parallel to said first slot, and a second guide slidably retained within said second slot, said slots being oriented to permit relative movement of said first and second helmet portions generally along a longitudinal axis of said helmet, said first slot having bump portions along a longitudinal edge thereof to encourage location of said guide between adjacent bumps.

14. The helmet of claim 13 wherein said first slot is from 3 to 30 millimeters long to permit relative movement of said helmet portions relative to each other of a similar magnitude.

15. The helmet of claim 14 wherein said first helmet portion comprises means for maintaining said securing member in said closed position.

16. The helmet of claim 15 wherein said means includes:

a protuberance located on one of said first helmet portion and said securing member; and an indent defined by portions of the other of said first helmet portion and said securing member, said indent receiving said protuberance when said securing member is in said closed position to inhibit movement of said securing member.

17. The helmet of claim 14 wherein said first helmet portion comprises means for maintaining said securing member in said open position.

18. The helmet of claim 17 wherein said means includes:

a protuberance located on one of said first helmet portion and said securing member; and an indent defined by portions of the other of said first helmet portion and said securing member, said indent receiving said protuberance when said securing member is in said open position to inhibit movement of said securing member.

19. The helmet of claim 16 or 18 wherein said first helmet portion defines an opening for slidably retaining therein said securing member.

20. The helmet of claim 19 wherein said securing member is slidably retained by engaging aligned edges of said opening.

21. The helmet of claim 20 wherein said securing member is retained within said opening by a slidable snap fit.

22. The helmet of claim 21 wherein said securing member includes a generally thin flat body for supporting said protrusion and protuberance on a side thereof.

23. The helmet of claim 22 wherein said protrusion and body are integrally formed.

24. The helmet of claim 23 wherein said securing member includes at least two protuberances in spaced relation to one another and each protuberance being located adjacent a periphery of said securing member.

25. The helmet of claim 24 wherein said securing member includes a surface for frictionally engaging a corresponding surface of said restraint when said securing member is moved to the closed position.

26. The helmet of claim 25 wherein securing member is made of a single injection molded plastic piece.

27. The helmet of claim 26 wherein said helmet further comprises a second securing member and a second restraint, said first and second securing members and the respective first and second restraints being located laterally on opposite sides of said helmet.

28. The helmet of claim 27 wherein said helmet further comprises padding attached to a concave surface of one of said first and second helmet portions, said padding moving when said attached helmet portion moves.

29. The helmet of claim 1 wherein said helmet is made of a material selected from the group consisting of: polymers, plastic, thermoplastics and fiberglass.

30. A helmet comprising:

a front portion and a back portion, said front and back portions defining a volume into which the head of a person will fit, said front portion comprising opposed first and second lateral portions, said back portion comprising opposed third and fourth lateral portions, said first lateral portion being configured and disposed to be adjacent said third lateral portion, said second lateral portion being configured and disposed to be adjacent said fourth lateral portion, said front portion being slidably engaged with said rear portion such that said volume is changeable, said first lateral portion comprising a depression having a bottom, said depression comprising a cavity disposed in said bottom, said cavity comprising spaced apart side edges, a securing member configured and disposed to be slidably engaged in said depression, said securing member being displaceable between an open and a closed position, said securing member comprising a base and a pedestal protruding laterally therefrom, said pedestal being sized and configured to be disposed through said cavity, said pedestal comprising opposed wings disposed to slidably engage said side edges, said pedestal comprising at least one protrusion projecting therefrom, away from said base, said third lateral portion comprising a restraint comprising an opening therethrough, said third lateral portion being sized to be larger than said cavity, said opening being disposed to cooperatively overlap said cavity, said opening comprising at least first and second spaced apart recesses on a bottom edge thereof, each of said recesses being sized to lockingly engage said protrusion, said cavity, opening, securing member and restraint being configured and disposed such that when said protrusion is lockingly engaged in said first recess, said volume is different than when said protrusion is lockingly engaged in said second recess.

31. The helmet of claim 30 wherein said depression comprises a hole therethrough in said bottom, said hole being sized to fit a rivet therethrough, said third lateral portion comprising a slot disposed to cooperatively overlap said hole, said rivet being sized to fit through said slot.

32. The helmet of claim 31 wherein said restraint comprises a plurality of recesses.

33. The helmet of claim 30 wherein said securing member is displaceable in a plane substantially parallel to the plane of the first lateral portion.

34. The helmet of claim 30 wherein the securing member is displaceable in the plane of said depression.

35. The helmet of claim 30 wherein said pedestal and said wings are configured to be snap-fitted through said cavity.

36. An adjustment mechanism for a helmet, the helmet having a first helmet portion, a second helmet portion connected to said first helmet portion, and the portions are movable relative to each other, the adjustment mechanism comprising:

a securing member mounted to the first helmet portion and slidable along an axis about the first helmet portion, said securing member including at least one protrusion; and a restraint located on the second helmet portion and complementary to said securing member, wherein said securing member and said restraint cooperate to inhibit movement of said first helmet portion relative to said second helmet portion when said securing member is moved to cooperatively contact said restraint, said restraint defining a recess for engaging said protrusion when said securing member is moved to cooperatively contact said restraint.

* * * * *